US006385888B1

(12) United States Patent
Power

(10) Patent No.: US 6,385,888 B1
(45) Date of Patent: May 14, 2002

(54) REVOLVER FIRING MECHANISM WITH DISENGAGING CYLINDER PAWL

(76) Inventor: Ron Power, 29739 Highway J, Gravois Mills, MO (US) 65037-9802

( * ) Notice: Subject to any disclaimer, the term of this patent is extended or adjusted under 35 U.S.C. 154(b) by 0 days.

(21) Appl. No.: 09/513,017

(22) Filed: Feb. 25, 2000

(51) Int. Cl.[7] ..... F91C 3/14
(52) U.S. Cl. ..... 42/65
(58) Field of Search ..... 42/65, 66

(56) References Cited

U.S. PATENT DOCUMENTS

| | | | | | |
|---|---|---|---|---|---|
| 933,797 | A | * | 9/1909 | Stone | 42/65 |
| 3,768,190 | A | * | 10/1973 | Ruger et al. | 42/65 |
| 3,777,384 | A | * | 12/1973 | Ruger et al. | 42/66 |
| 3,810,326 | A | * | 5/1974 | Hillberg et al. | 42/59 |
| 3,824,728 | A | * | 7/1974 | Kennedy | 42/66 |
| 5,160,795 | A | * | 11/1992 | Milliman | 42/65 |
| 5,548,914 | A | * | 8/1996 | Anderson | 42/66 |

* cited by examiner

*Primary Examiner*—Charles T. Jordan
*Assistant Examiner*—Jordan Lofdahl

(74) *Attorney, Agent, or Firm*—Donn K. Harms

(57) ABSTRACT

An improved trigger mechanism for a single action revolver. The device features a pawl which rotationally mounts upon a hammer having a firing position in which a hammer is cocked, and having an at rest position in which the hammer is biased against the revolver frame. The pawl has an engagement end which cooperatively engages and rotates an indexing ratchet of a rotating cylinder at a first end. A means for disengagement of the engagement end of the pawl from cooperative engagement with the indexing ratchet when hammer is in said at rest position is provided by a second section extending from an axis pin providing a mount for the pawl on the trigger hammer. A cam end having a length determined to provide operative contact with an interior wall surface of a shaft formed in said revolver causes a rotation of the pawl upon the axis pin thereby laterally translating said engagement end out of operative engagement with the cylinder ratchet when the hammer is rotated to said resting position. The resulting disengagement of the engagement end and the cylinder indexing ratchet provides for a free spin of the cylinder of the revolver in either direction during loading and unloading of the revolver. Other embodiments provide for disengagement of the engagement end of the pawl from cooperative engagement with the indexing ratchet when hammer is in said at rest position which could be incorporated in newly designed revolvers.

6 Claims, 4 Drawing Sheets

REVOLVER FIRING MECHANISM WITH DISENGAGING CYLINDER PAWL

BACKGROUND OF INVENTION

1. Field of Invention

The present invention relates to a device for improved operation of handguns. More particularly it relates to an improved pawl which, when used in combination with a Ruger® single action revolver such as the Vaquero®, the Blackhawk®, and handguns of similar mechanical single action operation. When installed, the improved pawl allows the handgun owner the ability to rotate the cylinder of a revolver either direction when the loading gate is open.

2. Prior Art

Revolver style handguns typically have a revolving cylinder which holds a number of cartridges to be fired by the firearm during use. Such cylinders allow for easy loading, firing, arid unloading of the revolver during use and give the user the ability to fire multiple rounds before having to reload the spent rounds in the cylinder. The capacity of revolving cylinder dictates the available rounds for firing by the user before reloading.

Loading and unloading the revolving cylinder of the typical Ruger® single action revolver such as the aforementioned models and revolvers of similar mechanical operations, traditionaly involve, opening the loading gate to gain access to the plurality of chambers in the revolving cylinder. Each such chamber is sized to accommodate the exterior circumference of the shell casing of the ammunition used to allow the ammunition to be slidably located inside the chamber. The number of chambers of courses determines the number of rounds available to be fired before the spent shell casings are removed from each chamber so that the chamber may be reloaded.

Single action revolvers, such as the aforementioned Ruger® revolvers and those of similar mechanical operation from both Ruger® and other manufacturers, conventionally are designed to allow a one direction rotation of the revolving cylinder by the factory pawl ratcheting the revolving cylinder. This one way rotation is accomplished by a ratchet style mechanical action of the factory pawl rotates the cylinder in one direction during the ratcheting action. At rest, the factory pawl is positioned to prevent a backward rotation of the rotating cylinder through positioning the pawl in contact with a cooperating part of the cylinder. During rotation using the factory pawl, with the loading gate open, the user hears a discernable clicking noise caused by the ratchet action of the engagement end of the factory pawl against the cooperating notches of the revolving cylinder. This interaction of the factory pawl continually engaging and disengaging notches on the revolving cylinder prevent reverse rotation of the cylinder as well as creating drag on the cylinder rotation. Consequently, users of revolvers of the aforementioned mechanical design may only load and unload the plurality of chambers with the conventional factory pawl activated revolving cylinder, by rotating the cylinder only in one direction.

The device disclosed herein are directed at an improved pawl configured for use in combination with the Ruger® single revolvers such as the Vaquero® and the Blackhawk® and revolvers of similar mechanical operation made by other manufacturers. Such revolvers have a removable trigger mechanism that is insertable into a shaft formed in the handgun body and are well known to those trained in the art. The free spin pawl herein described and disclosed, when installed on such revolvers, allow the user to take advantage of being able to load the chambers in the rotating cylinder of such revolvers by spinning the rotating cylinder in either direction. Additionally, the resistance caused by the ratcheting of the factory pawl against the rotating cylinder, which impedes the spin of the revolving cylinder when the loading gate is open, is eliminated. Eliminating this ratcheting contact when the revolver is in a resting or uncocked position, thus allows for a much easier and free spin in either direction by the user.

The disclosed device in it current best mode is a drop in part on most such revolvers and simply replaces the factory pawl. However, due to different tolerances in factory production of the aforementioned revolvers, some minor alterations are sometimes needed to assure a smooth and trouble-free operation. Generally however, removal of the factory provided cylinder pawl, and insertion of the free spin cylinder pawl herein disclosed, will afford the user the utility and benefits of a free spinning revolving cylinder when the loading gate is in the open position and the revolver is not cocked. This free spin of the cylinder not only makes it easier to spin than the original factory version, the cylinder may also be loaded by spinning it in either direction. This increased spinning utility of the revolving cylinder decreases the time needed to load and unload the spinning cylinder and also allows users with less dexterity a double option on how they wish to load their revolver.

U.S. Pat. No. 4,307,530 (Melcher) teaches trigger system and a cylinder latch mechanism for a revolver. However Melcher teaches the use of a continually engaging pawl for rotating the cylinder preventing the rotation of the cylinder one direction when The revolver is in an at rest state.

U.S. Pat. No. 4,067,131 (Ruger) teaches a firing mechanism for a revolver, however, Ruger also teaches the use of a continually engaged cylinder pawl which both prevents the rotation of the cylinder in one direction, and inhibits the free spin of the pawl in the allowed direction due to friction caused by the continuously engaged cylinder pawl.

As such, there exists a need for an easily and inexpensively manufactured trigger mechanism that will totally disengage the cylinder pawl from the cylinder when the firearm is in the at rest position. Such a device should allow the cylinder of the a revolver in which it functions, to rotate in either direction when the revolver is in an at rest position during loading and unloading. There exists an additional need for such a device that will also totally disengage from the cylinder and alleviate the drag caused thereon thus making the cylinder easier to rotate during loading and unloading.

SUMMARY OF THE INVENTION

Applicant's device provides an easily manufactured and installed cylinder pawl for retrofit to existing revolvers of the type described above which have removable trigger mechanisms that mount into a revolver frame. The disclosed improved pawl in the current best mode, and the additional pawl translating designs for newly manufactured similarly configured revolvers, when incorporated, allow for an unrestricted spin, in either direction, of the revolving cylinder of a conventional single action revolver style firearm, such as the aforementioned Ruger® single action Blackhawk® and Vaquero® revolvers and clones of these revolvers wherein the trigger mechanism is removable from a slotted frame configured for the revolving cylinder holding the ammunition for the revolver. In the current best mode of the device, a specially configured cylinder pawl, is easily installed in revolvers with little or no modification to the body, or to other components of the revolver during such installation. Such an easy installation is provided due to the inherent design characteristics to the aforementioned revolvers which feature a frame for carrying the revolving cylinder with the frame also being slotted to receive a trigger mechanism with a hammer and pawl which when operatively positioned in the slot in the frame operatively communicates with one end of the cylinder to rotate it.

The device features a unique configuration for a cylinder pawl in the current best mode which allows the pawl vertical translation using the conventional axis pin mount on the rotating hammer, as well as concurrent controlled lateral translation of the engagement end, away from engagement with the indexing ratchet located on the hammer side of the revolving cylinder. Unlike conventional cylinder pawls which have only a first end for engagement of the cylinder indexing ratchet which extends from only one side of their axis pin mounting, the device herein disclosed features a second end extending from the axis pin at a defined length and angle to yield a means for disengagement of the cylinder pawl from the cylinder ratchet when the trigger and mechanically cooperating hammer are in an at rest position. This is accomplished by extending the second end of the cylinder pawl at a calculated angle from the center axis extending through the first end, and for a defined distance, the second end contacts the wall surface of an internal shaft formed in the frame of the revolver.

Contact of the cam end with the wall surface of the internal shaft of the frame is maintained by a biased plunger or pin which in the current best mode features a spring loaded plunger in contact with the first or engagement end on the side of the engagement end opposite the cylinder indexing ratchet. Such spring loaded plunger arrangements are common on currently manufactured revolvers using the conventional permanently engaged pawl. In the disclosed device, once the cylinder pawl is installed, the biasing of the spring loaded plunger translates the engagement end of the pawl toward the cylinder indexing ratchet and thus like a fulcrum, translates the cam end in the opposite direction toward the internal wall surface of the internal shaft. This contact of the cam end with the surface of the internal shaft formed in the conventional frame, laterally translates the opposite engagement end, away from, or out of, operative engagement with the cylinder indexing ratchet, when the hammer rotates to the at rest position. Conversely, when the hammer is rotated from an at rest position, to a ready to fire position, rotation of the hammer causes the axis pin which mounts the cylinder pawl to move upward toward the cylinder indexing ratchet. During this upward substantially in line travel of the axis pin, the cam end of the disclosed cylinder pawl frictionally engages with the wall surface of the shaft to rotate the pawl on the axis pin causing a lateral translation of the engagement end toward the cylinder indexing ratchet and engagement therewith for a registered rotation of the cylinder to place a chamber in line with the barrel and hammer.

The amount of lateral translation of the engagement end of the cylinder pawl to a point where the pawl is out of engagement with the cylinder indexing ratchet, is controlled by the length of the second end portion from the axis pin to the end contacting the wall surface and also the angle of the second end from the center axis of the engagement end. The length from the center of the axis pin upon which the cylinder pawl mounts may vary depending on the angle of the center axis through the axis pin to the second end. The appropriate defined length and angle of the second end forming the cam will thus be a mixture of sufficient length to provide sufficient torque to easily translate the engagement end out of operational engagement with the indexing ratchet at the chosen angle, while maintaining contact with the wall surface of the interior shaft without binding during operation.

By concurrently translating the ratchet end of the cylinder pawl to disengagement from the cylinder indexing ratchet at the same time that the ratchet end is moving downward upon the axis mount on the hammer, a complete disengagement of the cylinder indexing ratchet from the cooperatively engaging ratchet end is achieved when the hammer is in an at rest state. The at rest state in a single action revolver occurs when the hammer is in the forward position closest to the cylinder and biased against the frame of the gun. It is in the at rest state in which revolvers are conventionally loaded with ammunition for firing, or, have unfired rounds removed from the revolver. This is done by inserting or removing the appropriate ammunition into the plurality of chambers formed into the revolving cylinder which hold the ammunition. These chambers are conventionally accessed through a loading gate pivotally attached to the frame at the hammer end of the revolving cylinder. The loading gates when rotated to an open position, allows the user access to the chambers of the rotating cylinder. The loading gate is also often mechanically engaged with a cylinder latch that engages a plurality of cylinder latch notches in the exterior circumference of the rotating cylinder. The latch notches are in positions that when engaged with the cylinder latch, register the position of the chambers with the barrel to place ammunition in the appropriate chamber in a position to be fired by the gun. Rotating the loading gate to the unsealed position allowing access to the chambers also retracts the cylinder latch and thereby allows the cylinder to spin.

In revolvers with conventional pawl and ratchet configurations, the conventional pawl lacks the second end and thus the cam formed thereby. As such, when the hammer is in the at rest position, the conventional pawl is forced forward forcing the ratchet at the end of the conventional pawl into continued cooperative operative engagement at its engagement end with the indexing ratchet of the cylinder. Thus, when the axis pin on the rotating hammer moves downward, the biasing pin maintains the ratchet end in contact with the indexing ratchet. The result being that when the loading gate is open and the cylinder stop retracted thereby, the cylinder is prevented from rotating in one direction by the engagement of the ratchet end with the indexing ratchet. Additionally, the spin of the cylinder in the one direction allowed by the conventional pawl is inhibited by the friction of the engagement end and the indexing ratchet and the biased pin thereon.

In the disclosed device however, the limitations of the prior art are overcome through the unique design of the cylinder pawl. The disclosed device, as noted, features the second end extending from the axis pin which acts as a cam in contact with the wall surface of the internal shaft in the body. As a consequence, whenever the hammer is rotated to the at rest position, the ratchet end distal to the cam on the second end, laterally translates away from, and out of engagement with, the indexing ratchet of the rotating cylinder. Thus, when the loading gate is opened causing the cylinder stop retracted, the cylinder will spin freely in either direction, and will spin smoothly because there is no friction upon the indexing ratchet from the disengaged ratchet end of the cylinder pawl.

The user is thus given enhanced ability to load and unload ammunition from the chambers for use or storage by the ability to rotate the cylinder in either direction for the task at hand. Further utility is provided by the smooth uninhibited rotation that the disengagement of the ratchet end from the indexing ratchet provides.

While the current best mode of the device herein disclosed accomplishes the lateral translation of the engagement end of the cylinder pawl using a second end distal to the engagement end which is dimensioned to act as a lever or cam to rotate the cylinder pawl and achieve the lateral translation and disengagement of the engagement end, in newly manufactured revolvers the manufacturer might also alter the surface of the interior shaft or add other fittings designed to laterally translate the engagement end of the pawl. Applicant has described other means of achieving the lateral translation of the engagement end out of contact with the cylinder indexing ratchet that can be designed for newly manufactured firearms. While not as good as the current best mode of a two ended cylinder pawl, these other means of achieving a lateral translation of the engagement end of the cylinder pawl could be designed into the frame of new manufactured goods or retrofitted to existing firearm frames at an additional expense, and as such, all such means for disengaging the ratchet end of the cylinder pawl, from the cylinder indexing ratchet, when the firearm is in the resting position are anticipated.

An object of this invention is the provision a cylinder pawl system for a revolver style revolver, that disengages from the cylinder when the revolver is in an at rest state.

Another object of this invention is to provide a cylinder pawl system that allows the revolving cylinder of a reolver style firearm to rotate easily in either direction during loading or unloading by providing a means for disengagement of the cylinder pawl from the cylinder when the firearm is in an at rest position.

A further object of this invention is the provision design changes that would allow newly manufactured revolver style revolvers to encompass a laterally translatable engagement end on the cylinder pawl to disengage the pawl during loading and unloading procedures.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
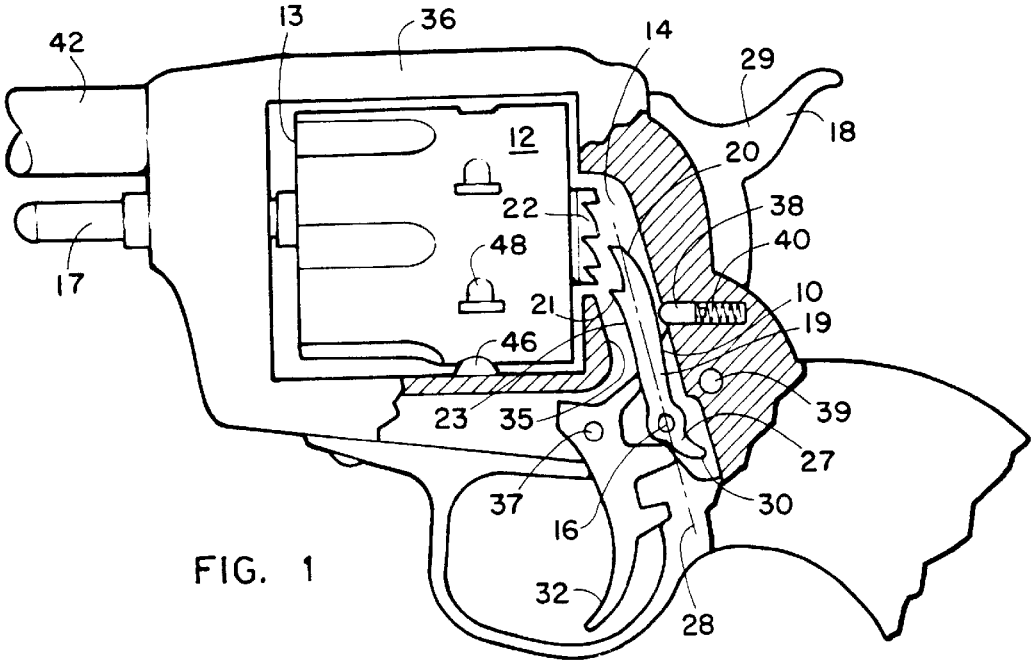
FIG. 1 is side cut away view of the disclosed improved pawl featuring a cylinder pawl which disengages with the revolver is in an at rest position.
Figure 2:
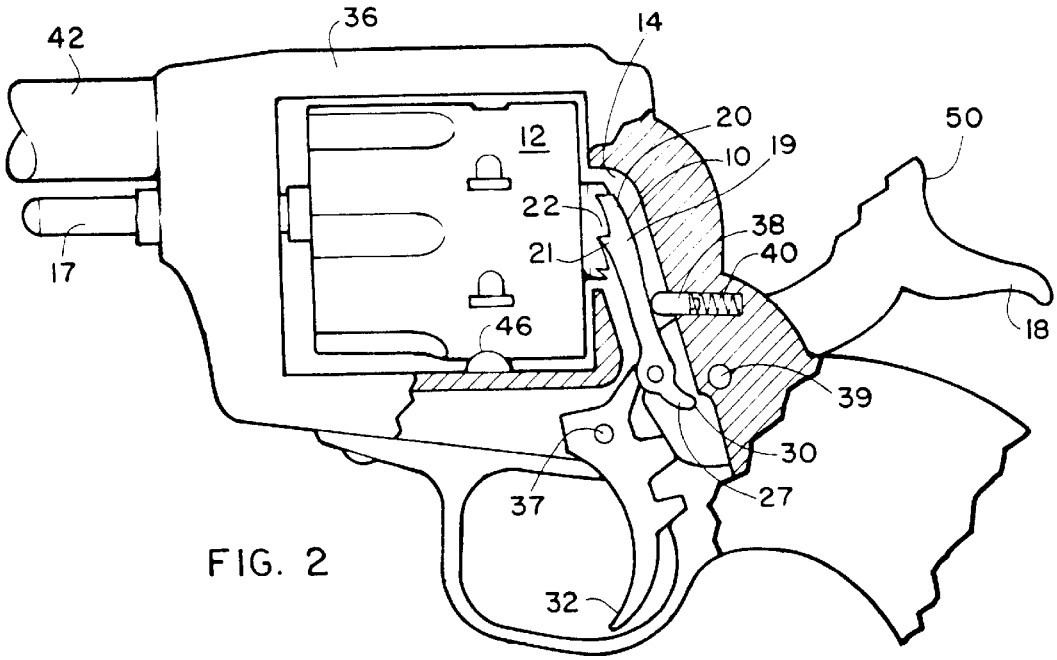
FIG. 2 is side cut away view of the pawl disengaging trigger system showing the pawl in a revolver with the hammer cocked in the ready to fire position.

Referring now to the drawings FIGS. 1–8 Applicant's device in the current best mode is an easily manufactured and installed cylinder pawl 10 for retrofit to existing single action revolvers and in newly designed and manufactured single action revolvers. When operatively engaged in the triggering system of revolvers of conventional single action design, the device in various embodiments will allow for an unrestricted rotation, in either direction, of the rotating cylinder 12 of a conventional single action revolver style firearm. In the current best mode the device, easily incorporated as a retrofit to in use or currently manufactured single action revolvers of the type herein described, a specially configured cylinder pawl 10 is easily installed in such revolvers with little or no modification to the body or other components of the revolver during such installation.

The current best configuration of the disclosed cylinder pawl 10 allows for vertical translation of the cylinder pawl 10 along the axis of the interior shaft 14 when the axis pin 16 mounting for the cylinder pawl 10 is translated upon its mount with a rotating hammer 18 in their normal operation. When operatively installed in a single action revolver, the improved cylinder pawl 10, provides concurrently with the vertical translation of cylinder pawl 10 in the interior shaft 14, a defined amount of lateral translation of the engagement end 20 of the cylinder pawl 10, away from the indexing ratchet 22, located on the hammer end of the rotating cylinder 12 which rotates on cylinder pin 17. Unlike a conventional pawl 11 which has only a first section 19 terminating in an engagement end 20 extending from a mount on the axis pin 16, the best embodiment of the cylinder pawl 10 herein disclosed features a means for disengagement of the engagement end 20 from cooperative engagement with the indexing ratchet 22 formed by a second section 27 extending from the axis pin 16 and terminating at a second or cam end 30. This means for disengagement of the engagement end 20 of the cylinder pawl 10 from cooperative operative engagement with the indexing ratchet 22 is provided by the lateral translation of the engagement end 20 away from and out of cooperative engagement with, the indexing ratchet 22, when the hammer 18 is rotated on its mounting pin 39, to the at rest position 29 with the hammer 18 biased against the revolver frame 36. The means for disengagement of the engagement end 20 of the cylinder pawl 10 from cooperative operative engagement with the indexing ratchet 22 in the current best mode of the cylinder pawl 10 is accomplished by the provision of a second section 27 of the cylinder pawl 10 extending from the pawl mount at the axis pin 16. The second section 27 extends at a calculated angle from the center axis 28 of the cylinder pawl 10 extending through the first section 19, and for a defined distance wherein the second section 27 terminates at the cam end 30.

In this embodiment of the pawl 10, when the hammer 18 rotates on its mounting pin 39 to the at rest position 29, the cam end 30 contacts the wall surface 34 of the conventional interior shaft 14 formed in the revolver frame 36 of the revolver. Contact of the cam end 30 with the wall surface 34 of the interior shaft 14 in the revolver frame 36 during travel upward and downward in the interior shaft 14, is maintained by a biased plunger 38 in contact on the first side 21 of the first section 19 opposite the second side 23 adjacent to the cylinder indexing ratchet 22. The biased plunger 38 is normally biased toward the indexing ratchet 22 by a biasing means such as a spring 40. Such biased plunger 38 arrangements are common on conventionally manufactured revolvers using the conventional permanently engaged conventional pawl 11.

In the current best embodiment of the disclosed device, once the improved cylinder pawl 10 is operatively installed by removing the conventional pawl 11 and inserting the improved cylinder pawl 10 in its place, the biased plunger 38 translates the engagement end 20 of the cylinder pawl 10 toward the cylinder indexing ratchet 22, and like a fulcrum, translates the cam end 30 in the opposite direction toward the internal wall surface 34 of the shaft 14. Contact of the cam end 30 with the wall surface 34 of the shaft 14 stops, and reverses the fulcrum action and laterally translates the engagement end 20, away from and out of cooperative engagement with the cylinder indexing ratchet 22, when the hammer 18 is rotated, from the ready to fire position 50 to the at rest position 29. Conversely, when the hammer 18 is rotated from an at rest position 29, to a ready to fire position 50, rotation of the hammer 18 causes the axis pin 16 providing the rotational mount for the cylinder pawl 10, to move upward inside the interior shaft 14 toward the cylinder indexing ratchet 22. During this upward substantially in line travel of the axis pin 16, and attached cylinder pawl 10, the cam end 30 frictionally engages with the wall surface 34 of the interior shaft 14 causing a determined rotation of the cylinder pawl 10 on the axis pin 16 thereby laterally translating the engagement end 20 toward the rotating cylinder 12. This lateral translation of the engagement end 20 results in functional engagement between the cylinder indexing ratchet 22 when the cam end 30, riding on the wall surface 34, reaches a point in the wall surface 34, where frictional engagement ceases due to a diversion of the conventional wall surface 34 away from the cam end 30. Cessation of travel of the cam end 20 over the wall surface 34 occurs at substantially the same time as the cessation of the rotation of the cylinder pawl 10 when the engagement end 20 reaches a cooperative engagement with the cylinder indexing ratchet 22 by laterally translating into such engagement. At the point of functional engagement of the engagement end 20 with the indexing ratchet 22 rotation of the pawl 10 caused by the biased pin ceases due to the contact between the engagement end 20 and the indexing ratchet 22. As noted, at the same time, the cam end 30 is substantially out of contact with the wall surface 34 due to the dimension and angle of the wall surface 34 at the point reached by the cam end 30 when functional engagement of the indexing ratchet 22 and engagement end 20 causes rotation of the cylinder pawl 10 to cease. During the upward travel of the axis pin 16 in the interior shaft 14 this lateral translation and cooperative engagement also provides for rotation of the rotating cylinder 12 by the action of the engagement end 20 rotating the indexing ratchet 22 and attached rotating cylinder 12, causing the cylinder 12 to reach a registered position with one of the chambers 13 with the rotating cylinder 12 in line with the barrel 42 and hammer 18.

The amount of lateral translation of the engagement end 20 of the cylinder pawl 10 away from the cylinder indexing ratchet 22, in the current best mode of the translating cylinder pawl 10, is controlled by the length and angle of the second section 27 from the axis pin 16 to the cam end 30 which determines contact the wall surface 34. The length of the second section 27 affects the contact of the cam end 30 with the wall surface 34 thereby determining the a resulting fulcrum effect on the cylinder pawl 10 wherein it rotates on the axis pin 16. Also, the angle center axis of the second section 27 from the center axis 28 or the first section 19 will effect the needed length of the second section 27 due to changes in the resulting fulcrum effect caused by differing contact of the cam end 30 with the varying wall surface 34. The appropriate defined length and angle on the second section 27 from its starting point at the axis sin 16 and terminating in the cam end 30 will thus be a mixture of sufficient length to provide sufficient torque to easily translate the engagement end 20 out of contact with the indexing ratchet 22 when the hammer 18 rotates to place the hammer 18 to the resting position 29 while maintaining contact with the wall surface 34 of the interior shaft 14 during vertical translation in the interior shaft 14 without binding during operation.

By concurrently translating the engagement end 20 of the cylinder pawl 10 to disengagement from the cylinder indexing ratchet 22 at the same time that the engagement end 20 is moving downward in the interior shaft 14 during rotation of the hammer 18 causing a lateral translation of the attached axis pin 16, a complete disengagement of the cylinder indexing ratchet 22 from the cooperatively engaging engagement end 20 of the cylinder pawl 10 is achieved ,and maintained, while the hammer 18 and revolver is in an at rest position 29.

It is in the at rest position 29 in which Ruger® single action revolvers and revolvers of similar mechanical operation are conventionally loaded with ammunition (not shown) for firing, or, have unfired ammunition removed from chambers 13 in the rotating cylinder 12. This is accomplished by inserting or removing the appropriate ammunition into the plurality of chambers 13 formed into the rotating cylinder 12. These chambers 13 are conventionally accessed through a loading gate 44 pivotally attached to the revolver frame 36 at the rear portion of the rotating cylinder 12 adjacent to the hammer 18. The loading gate 44, when rotated to an open position, allows the user access to the chambers of the rotating cylinder 12.

The loading gate 44 is also often mechanically engaged with a retracting cylinder stop 46 that engages a plurality of cylinder latch notches 48 in the exterior circumference of the rotating cylinder 12 when the revolver is in a ready to fire position 50 with the hammer 18 in a frictional cocked engagement with a cam on the trigger 32. The latch notches 48 are in positions, which when engaged with the retracting cylinder stop 46, by rotating the hammer 18 to the ready to fire position 50, register the position of the chambers 13 with the barrel 42 to place ammunition in the appropriate chamber 13 in a position to be fired by the gun. Rotating the loading gate 44 open, allowing access to the chambers 13, also translates the retracting cylinder stop 46 to a retracted position out of cooperative engagement with the latch notches 48 and thereby allows the rotating cylinder 12 to spin during loading and unloading sessions.

Figure 3:
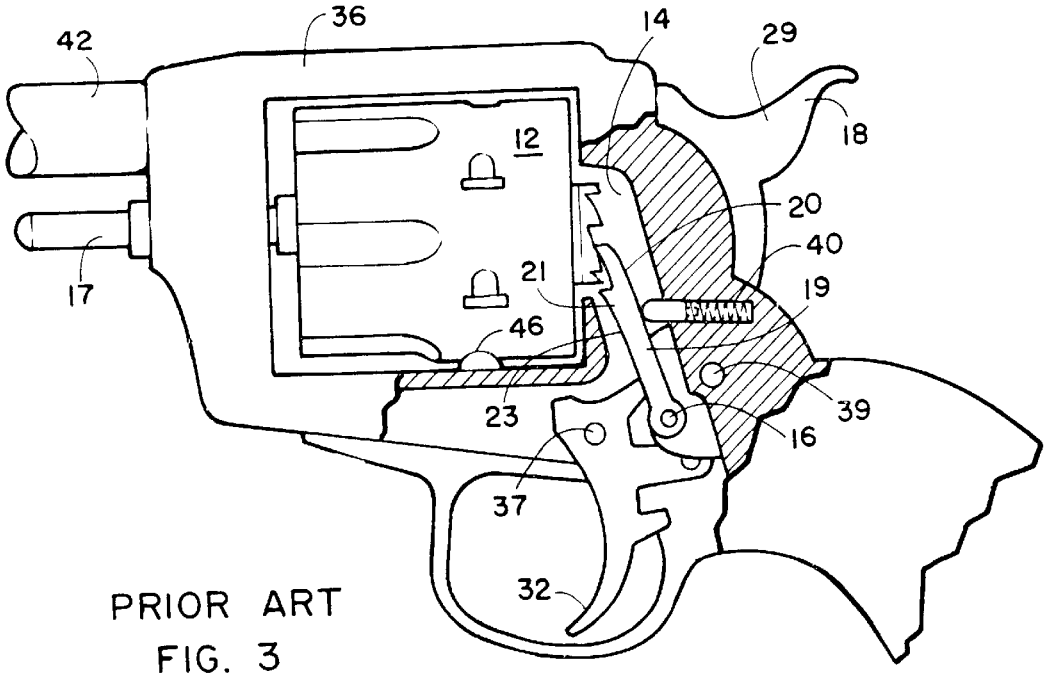
PRIOR ART FIG. 3
FIG. 3 is a side cut away view of the pawl action in prior art conventional single action revolver trigger systems which feature a permanently engaged pawl.
Figure 4:
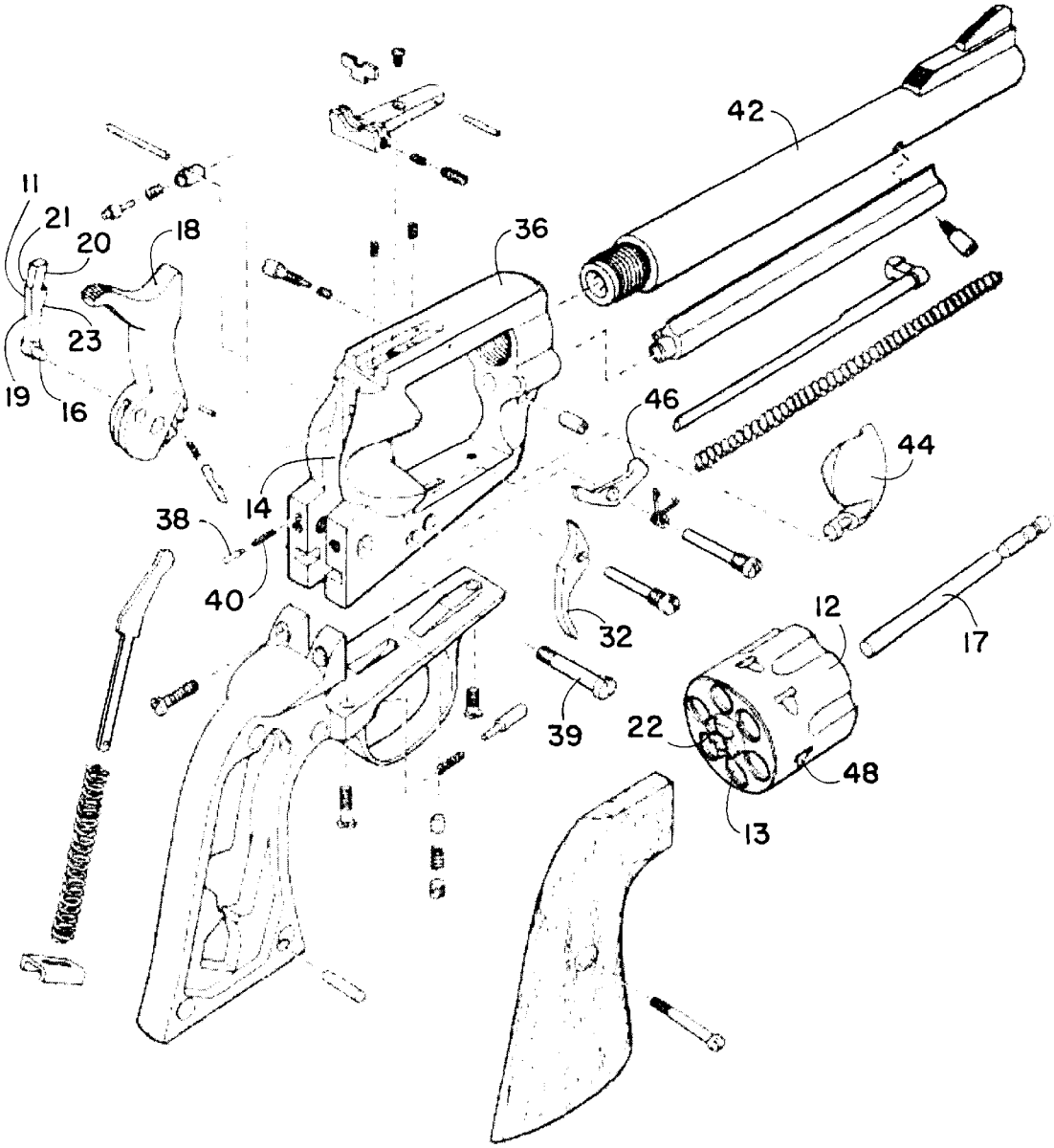
FIG. 4 PRIOR ART
FIG. 4 is a prior art exploded view of a conventional single action revolver for use in combination with the improved pawl embodiments herein disclosed.

In revolvers with conventional pawl 11 and ratchet configurations, depicted in FIGS. 3 and 4, the conventional pawl 11 lacks a means for disengagement of the engagement end 20 from cooperative engagement with the indexing ratchet 22 provided by the second portion 27 and the action of the cam end 30 formed thereby. As such, in conventional described single action revolvers, when the hammer 18 is in the at rest position 29, the conventional pawl 11 is biased forward by contact with the spring biased plunger 38 thereby biasing the engagement end 20 into continuous operative engagement with the indexing ratchet 22. Thus, in conventional designs having the conventional pawl 11, when the axis pin 16 on the rotating hammer 18 moves downward in the interior shaft 14 during the forward rotation of the hammer 18, the spring biased plunger 38 maintains the engagement between the engagement end 20 of a conventional pawl 11 and the indexing ratchet 22 on the rotating cylinder 12. The result being that when the loading gate 44 is open thereby translating the retracting cylinder stop 46 to a retracted position, the rotating cylinder 12 is still prevented from rotating in one direction, by the continued operative engagement of the engagement end 20 of the conventional pawl 11 with the indexing ratchet 22 of the rotating cylinder 12.

In the disclosed device however, the limitations of the prior art are overcome through the unique design of the improved cylinder pawl 10 which provides a means for disengagement of the engagement end 20 from cooperative engagement with the indexing ratchet 22. The user is thus given enhanced ability to load and unload ammunition from the chambers 13 in the rotating cylinder 12 by the ability to freely rotate the rotating cylinder 12 in either direction for the task at hand. Additionally, in extremely smooth rotation is provided by elimination of the friction from the ratchet engagement of the engagement end 20 from the indexing ratchet 22 which the improved cylinder pawl 10 provides.

It should be understood that while the preferred embodiment of the device herein disclosed employs an improved cylinder pawl 10 configured with a second section 27 terminating in the cam end 30 to provided the means for disengagement of the engagement end 20 from cooperative engagement with the indexing ratchet 22 to thereby yield greatly improved performance and utility in the unrestricted rotation of the rotating cylinder 12, other embodiments could be employed in to yield the disclosed temporary disengagement through lateral translation of the cylinder pawl 10 from the indexing ratchet 22. Such embodiments may be achieved in newly designed single action revolvers. Such designs would be less desirable to be incorporated on many currently used single action revolvers due to cost and time for retrofitting revolvers already manufactured and in service, even though they could be so incorporated by replacement of the body or other parts at extra expense. However, in new designs and resulting manufacture of the conventional single action revolver, the revolver frame 36 or other parts could be redesigned to allow for the conventional pawl 11 with little or no modification to incorporate a means for disengagement of the engagement end 20 from cooperative engagement with the indexing ratchet 22 through modifications to the revolver frame 36 or the interior shaft 14.

Figure 5:
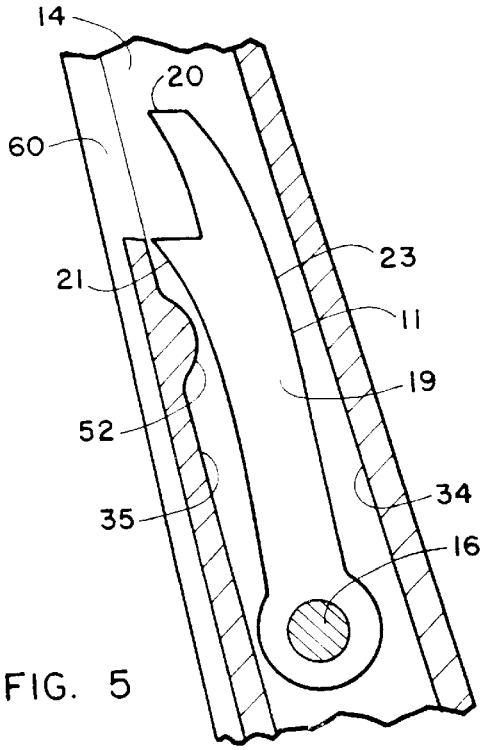
FIG. 5 depicts a side cut away view of another embodiment of the disclosed device for temporarily disengaging the cylinder pawl.

FIG. 5 depicts a side cut away view of an embodiment of the device herein to allow for a means of disengagement of the engagement end 20 of the conventional pawl 11 from cooperative engagement with the indexing ratchet 22 when the revolver is in the at rest position 29 through the inclusion of a raised portion 52 positioned in the interior shaft 14 at a determined point to cause the lateral translation of the conventional pawl 11 from cooperative engagement with the engagement end of the indexing ratchet 22 when the revolver is in the at rest position 29. The first side 21 of the pawl would contact the raised portion 52 when vertically translated in the aforementioned operation and thereby disengage the engagement end 20 from the indexing ratchet 22.

Figure 6:
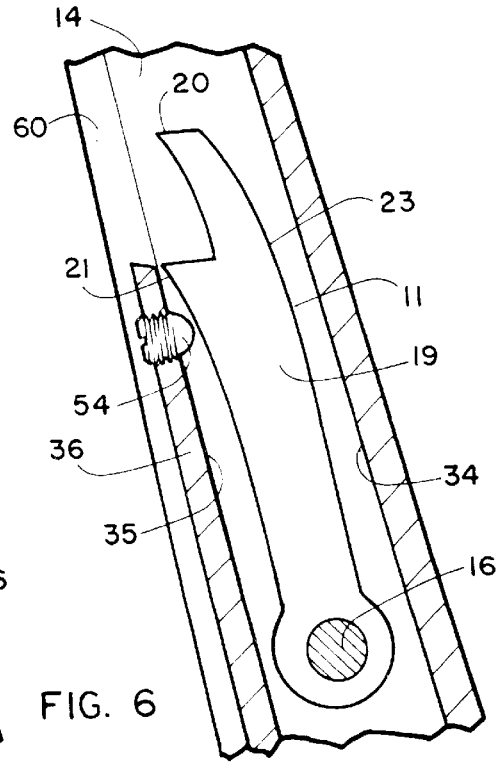
FIG. 6 depicts an additional embodiment of the disclosed device for temporarily disengaging the cylinder pawl of a revolver.

FIG. 6 depicts an another embodiment of the disclosed device for temporarily disengaging the conventional pawl 11 from the indexing ratchet 22. In this embodiment, an adjustable threaded pin 54 would be included that would threadably engage the revolver frame 36 to protrude the desired amount into the interior shaft 14 at a defined point and thereby function in the same manner as the aforementioned raised portion 52. This embodiment would provide adjustability of the lateral translation of the engagement end 20 of the conventional pawl 11 away from the indexing ratchet 22 in the at rest position 29 and could be incorporated in newly manufactured revolvers by inclusion of the treaded engagement for the threaded pin 54 and the threaded pin 54 itself.

Figure 7:
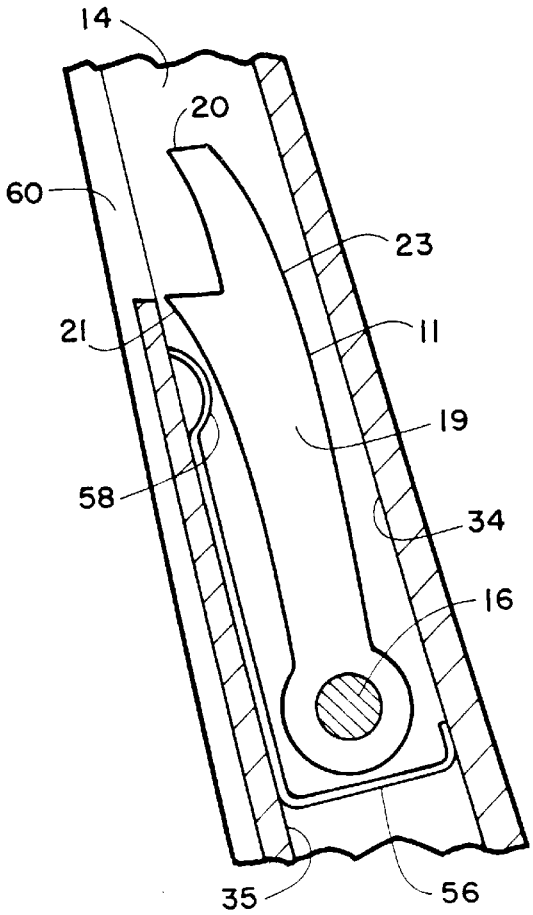
FIG. 7 depicts a further embodiment of the disclosed device for temporarily disengaging the cylinder pawl of a revolver.

FIG. 7 depicts a further embodiment of the disclosed device for temporarily disengaging the cylinder pawl 10 of a revolver in the form of a clip 56 that could be inserted into the interior shaft 14 to operatively mount therein. The clip 56 would have the raised portion 52 formed at one end and would frictionally engage the interior shaft 14 for operative positioning of the raised portion 52 therein. The clip 56 would be best of a flat spring steel and have a "U" shape at one end to provide the needed frictional engagement in the interior shaft 14.

Figure 8:
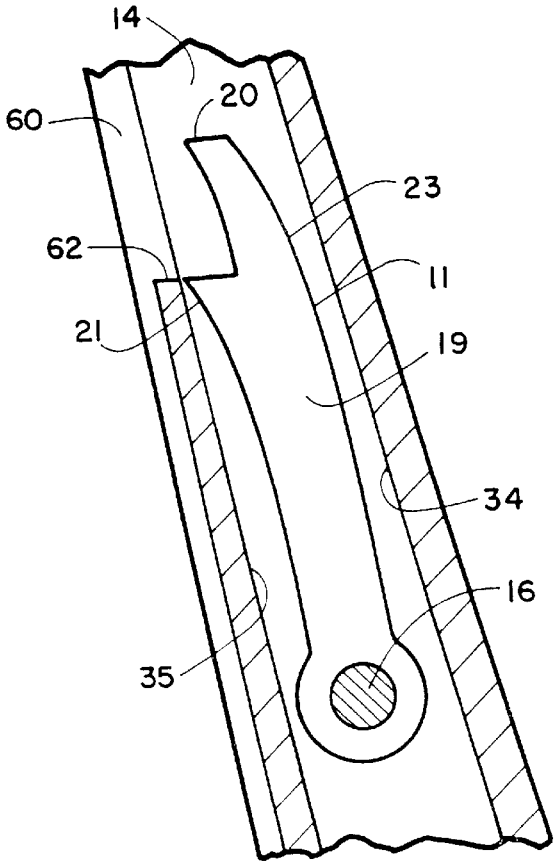
FIG. 8 depicts a further embodiment of the disclosed device for temporarily disengaging the cylinder pawl of a revolver.

FIG. 8 depicts a further embodiment of the disclosed device for temporarily disengaging the conventional pawl 11 of a revolver in the form of positioning the lower edge 62 of the window 60 formed in forward wall surface 35 of the interior shaft 14 for communication of the hammer 18 therethrough to contact ammunition in the chambers 13 of the rotating cylinder 12 during firing. In this embodiment the lower edge 62 of the window would be positioned to engage the first side 21 of the conventional pawl 11 and translate the pawl engagement end 20 out of cooperative engagement with the indexing ratchet 22 in the at rest position 29 of the revolver.

While all of the fundamental characteristics and features of the Improved Revolver Firing Mechanism with Disengaging Cylinder Pawl have been shown and described, it should be understood that various substitutions, modifications, and variations may be made by those skilled in the art, without departing from the spirit, or scope of the invention. Consequently, all such modifications and variations are included within the scope of the invention as defined by the following claims.

What is claimed is:

1. An improved trigger mechanism for use in combination with single action revolvers having a firing position in which a hammer is cocked, and having an at rest position in which the hammer is biased against the revolver frame, and having a pawl which cooperatively engages and rotates an indexing ratchet of a rotating cylinder, comprising:

a cylinder pawl said pawl having an axis pin extending therefrom, said axis pin providing a rotational mount for said pawl;

said axis pin mounted upon a hammer which is rotationally mounted to a frame portion of said revolver, said hammer having an at rest position biased against said frame and having a ready to fire position;

said cylinder pawl having a first section extending from said axis pin, said first section extending into a shaft formed in said frame and terminating in a ratchet end, said ratchet end configured for cooperative engagement with an indexing ratchet of a rotating cylinder of a revolver when said hammer is in said resting position; and means for disengagement of said engagement end of said pawl from said cooperative engagement with the indexing ratchet when said hammer is in said at rest position, whereby said engagement end of said pawl is disengaged from said cooperative engagement with said indexing ratchet while said hammer is in said at rest position thereby allowing said rotating cylinder to rotate freely.

2. The improved trigger mechanism according to claim 1 wherein said means for disengagement of said engagement end of said pawl from cooperative engagement with said indexing ratchet comprises:

said cylinder pawl having a second section extending from said axis pin;

said second section terminating in a cam end;

said second section having a length determined to provide operative contact of said cam end with the interior wall surface of said shaft formed in said revolver; and said operative contact of said cam end with said interior surface causing a rotation of said pawl upon said axis pin thereby laterally translating said engagement end out of said operative engagement with said cylinder ratchet when said hammer is rotated to said resting position.

3. The improved trigger mechanism according to claim 1 wherein said means for disengagement of said engagement end of said pawl from cooperative engagement with said indexing ratchet comprises:

a raised area positioned in the said shaft at a determined point to contact a first side of said pawl and thereby cause said lateral translation of the said pawl thereby causing said engagement end of pawl to translate out of said cooperative engagement with the indexing ratchet when said hammer is in said rest position.

4. The improved trigger mechanism according to claim 1 wherein said means for disengagement of said engagement end of said pawl from cooperative engagement with said indexing ratchet comprises:

an adjustable threaded pin threadably engaged into said frame, said threaded pin adjusted to protrude a desired amount into said shaft at said determined point thereby causing said engagement end of pawl to translate out of said cooperative engagement with the indexing ratchet when said hammer is in said rest position.

5. The improved trigger mechanism according to claim 1 wherein said means for disengagement of said engagement end of said pawl from cooperative engagement with said indexing ratchet comprises:

a clip, said clip dimensioned for insertion into said shaft to operatively mount therein; and said clip having a raised portion formed at one end positioned at said determined point, said raised portion contacting first side of said pawl when said hammer moves to said at rest position thereby causing said engagement end of pawl to translate out of said cooperative engagement with the indexing ratchet when said hammer is in said rest position.

6. The improved trigger mechanism according to claim 1 wherein said means for disengagement of said engagement end of said pawl from cooperative engagement with said indexing ratchet comprises:

a window formed in said shaft, said window providing communication of said pawl therethrough towards said cylinder;

a lower edge of said window dimensioned to engage said first side surface of said pawl and translate said engagement end out of said cooperative engagement with said indexing ratchet when said hammer moves to said at rest position.

* * * * *